US005309675A

United States Patent [19]

Shen et al.

[11] Patent Number: 5,309,675

[45] Date of Patent: May 10, 1994

[54] WINDOW STRUCTURE WITH A SLIDING DOOR

[75] Inventors: David Shen, Cupertino; Robert A. Howard, Mountain View, both of Calif.

[73] Assignee: Apple Computer, Inc., Cupertino, Calif.

[21] Appl. No.: 41,394

[22] Filed: Mar. 31, 1993

[51] Int. Cl.[5] ..... E05D 15/10

[52] U.S. Cl. ..... 49/214; 49/213; 49/211; 49/208

[58] Field of Search ..... 49/213, 214, 404, 208, 49/211

[56] References Cited

U.S. PATENT DOCUMENTS

| | | | |
|---|---|---|---|
| 770,829 | 9/1904 | Smart | 49/214 |
| 773,127 | 10/1904 | Dentler | 49/214 |
| 903,406 | 11/1908 | Rickabaugh | 49/214 |
| 1,287,606 | 12/1918 | Allmand | 49/211 |
| 1,712,562 | 5/1929 | Jeffers | 49/214 |
| 3,204,999 | 9/1965 | Schwenk | 49/213 |
| 3,216,716 | 11/1965 | Lunde et al. | 49/213 X |

FOREIGN PATENT DOCUMENTS

| | | | |
|---|---|---|---|
| 697839 | 11/1964 | Canada | 49/214 |
| 1460828 | 12/1966 | France | 49/214 |
| 1150067 | 4/1969 | United Kingdom | 49/213 |

*Primary Examiner*—Peter M. Cuomo
*Assistant Examiner*—Jerry Redman
*Attorney, Agent, or Firm*—Heller, Ehrman, White & McAuliffe

[57] ABSTRACT

A window structure has a door which slides substantially parallel to a wall to open and close a window therein and hides parallel to and behind the wall when the window is opened. Guide pins protrude upward and downward from the door, and elongated slots are formed in guide plates attached to the wall so as to serve as passageways for the guide pins to travel therein and therealong as the door is slidably moved between open and closed positions. A biasing member such as a cantilevered plate spring is provided to keep the window closed with its biasing force once it is closed and to prevent it from closing when the door is in open position.

9 Claims, 2 Drawing Sheets

WINDOW STRUCTURE WITH A SLIDING DOOR

BACKGROUND OF THE INVENTION

This invention relates to a window structure, and more particularly to a wall with a window having a door which slides to open and close it.

Doors typically open and close via hinges and stay closed via a latch, a knob or a similar mechanism. Some doors are detachable when open, and remain closed via latches, hooks and tabs which hold the door to the surrounding walls. Doors which open and close via hinges take up space outside the boundaries of the surrounding walls. Moreover, hinged doors are damaged easily because the main portion of the door, when open, is outside the protection of the surrounding walls. Detachable doors, on the other hand, have the disadvantage of being easily lost.

It is therefore an object of the present invention to provide a window structure with a door which does not take up much space outside but resides within the wall when open.

It is another object of the invention to provide a window structure with a door which is protected by a surrounding wall and hence is not damaged easily.

It is still another object of the invention to provide such a window structure with a cost-effective door which can be held open or closed.

SUMMARY OF THE INVENTION

A window structure embodying the present invention, with which the above and other objects can be accomplished, may be characterized as having a door which slides substantially parallel to a wall to open and close a window therein and hides parallel to and behind the wall when the window is opened. Guide pins protrude upward and downward from the door, and elongated slots are formed in guide plates attached to the wall so as to serve as passageways for the guide pins to travel therein and therealong as the door is slidably moved between open and closed positions. A biasing member such as a cantilevered plate spring is provided to keep the window closed with its biasing force once it is closed and to prevent it from closing when the door is in open position.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

Throughout herein, directions such as "right" and "left" are with reference to these figures.

DETAILED DESCRIPTION OF THE INVENTION

Figure 1:
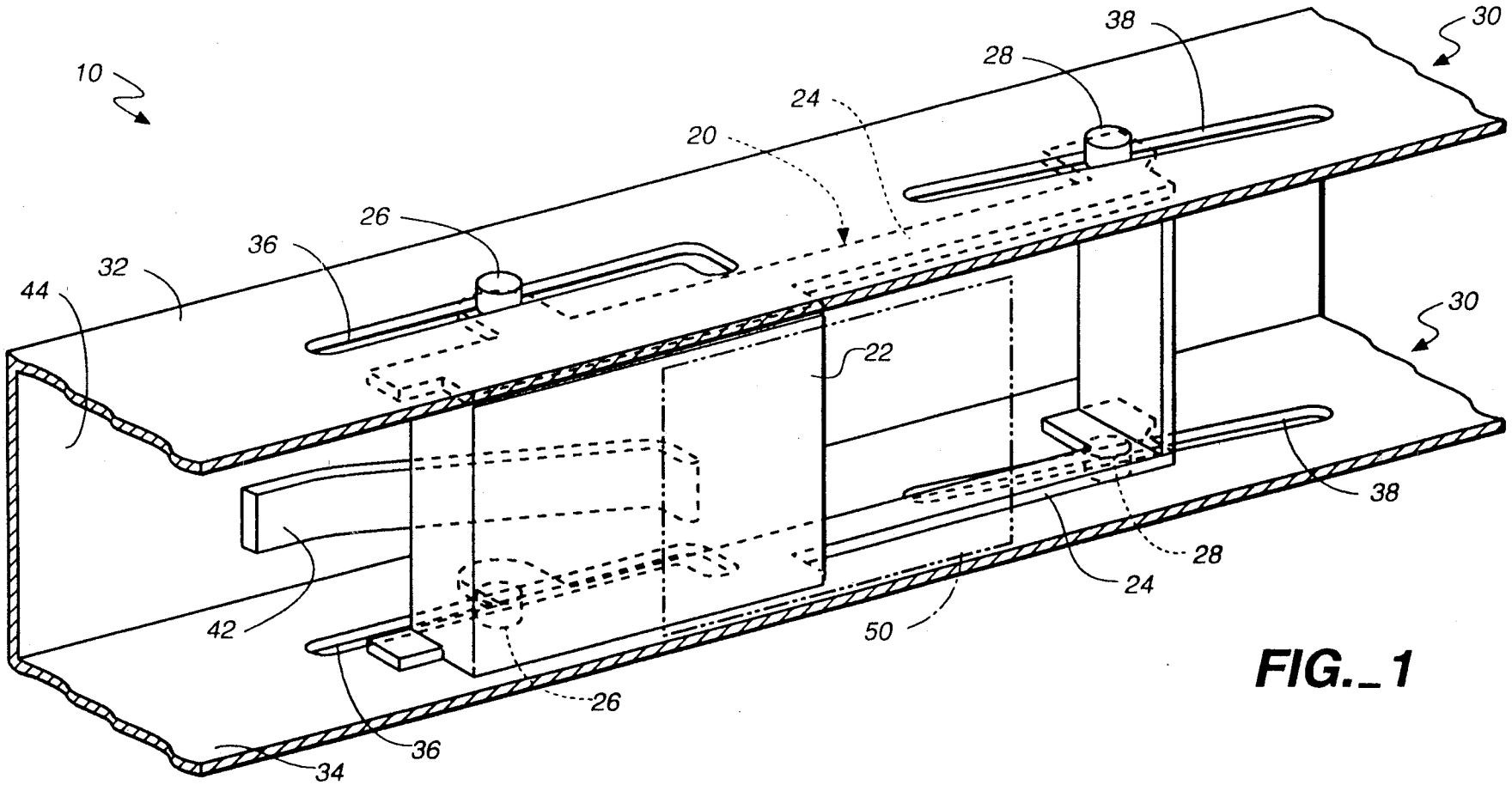
FIG. 1 is a perspective schematic view of a sliding door assembly embodying the invention for a window structure with a windowed wall removed for the sake of convenience.

FIG. 1 schematically shows a sliding door assembly 10 for a window structure embodying the present invention for opening and closing a rectangular window in a planar wall. For the sake of convenience of description and clarity of disclosure, the wall is not shown in FIG. 1. Only the position of the window to be opened and closed by the sliding door assembly 10 is outlined by broken lines indicated by numeral 50.

Described broadly, the sliding door assembly 10 essentially consists of a door structure 20 for sliding in one horizontal direction to open the window 50 and in the opposite direction to close it, and a guide structure 30 for supporting the door structure 20 slidably thereon along a specified trajectory. The door structure 20 includes a door panel 22 for completely covering the window 50 when the window 50 is to be closed, and a frame 24 from which guide pins 26 and 28 protrude vertically upward and downward. Only those of the pins 26 and 28 protruding upward are visible in FIG. 1. The sliding door assembly 10, including the door structure 20, is formed essentially symmetrically upward and downward, that is, with respect to a horizontal plane in the middle. In what follows, therefore, only those of the guide pins 26 and 28 protruding upward will be explained.

The guide structure 30 essentially consists of two identically designed, horizontally extending guide plates 32 and 34 one above the other and both affixed to the wall (not shown) in which the window 50 is formed. Each of the guide plates 32 and 34 has two elongated slots 36 and 38 for receiving therein the guide pins 26 and 28 protruding in the same direction such that the door structure 20, as a whole, is supported between the two guide plates and slidable horizontally as the guide pins 26 and 28 each move inside and along the respective one of the slots 36 and 38.

Next, the sliding motion of the door structure 20 will be described more in detail with reference to FIGS. 2A, 2B and 2C wherein numeral 40 indicates the windowed wall which was omitted in FIG. 1. It is to be noted that the slot 38 for the right-hand guide pin 28 is substantially straight and slightly oblique to the plane of the window 50 but the slot 36 for the left-hand guide pin 26 is L-shaped with a short branch extending perpendicularly to the plane of the window 50 and a much longer branch extending to the left substantially parallel to the plane of the window 50.

Figure 2A:
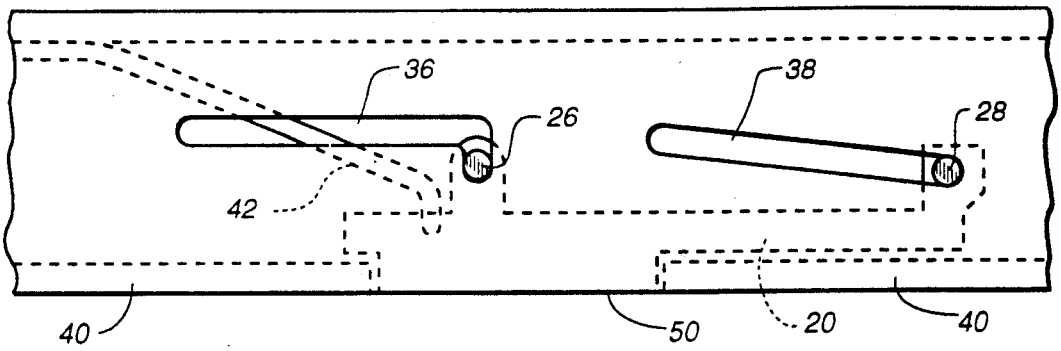
FIGS. 2A, 2B and 2C are plan views of the window structure of FIG. 1 when the door is completely closed, when it is about to be opened and when it is completely closed, respectively.

FIG. 2A shows the door structure 20 in its closed position, that is, when the window 50 is completely closed with the door panel 22. When the door structure 20 is in this position, the guide pins 26 and 28 are at the end points on the right-hand side of the corresponding slots 36 and 38. An elongated cantilevered plate spring 42 extends horizontally as shown in FIG. 1, with one end attached to a vertical frame 44 affixed to the guide plates 32 and 34. Its free end is in contact with the back surface of the door panel 22. The biasing force of the plate spring 42 is in the forward direction so as to keep the door panel 22 pushed against the periphery of the window 50, or to keep the window 50 closed.

When it is desired to open the window 50, the door panel 22 is pushed backward against the aforementioned forward biasing force of the plate spring 42. Since the guide pins 26 on the left-hand side are located behind the door panel 22 while the other guide pins 28 are farther to the right from the door panel 22, the initial motion of the door structure 20 is nearly rotational around the guide pins 28 on the right-hand side. In the meantime, the left-hand guide pins 26 each pass through the shorter branch of the corresponding L-shaped slot 36, reaching where the slot has a sharp bend. The distance of this shorter branch of the L-shaped slot 36 is about equal to the thickness of the wall 40. Thus, as the door panel 22 is pushed backward and the left-hand guide pins 26 move as far backward as possible inside the slots 36 to the position illustrated in FIG. 2B, the door panel 22 is sufficiently removed from the plane of the window 50 so as to be able to move parallel to the wall 40 without hitting it in the next step to be described below.

Figure 2B:
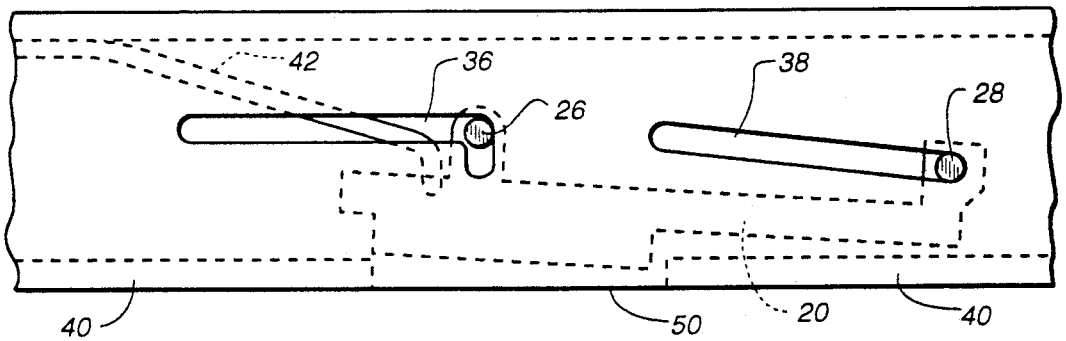

After the door panel 22 is pushed backward as far as it can go to the position shown in FIG. 2B, at which the door structure 20 is oblique to the windowed wall 40, the door structure 20 is pushed to the left with the guide pins 26 and 28 respectively guided by the slots 36 and 38. Because this part of the left-hand slots 36 (that is, the longer arm of the L-shape) is substantially parallel to the wall 40 while the right-hand slots 38 are oblique to it, the door structure 20 rotates slightly in the counterclockwise direction as it is pushed to the left. By the time the door structure 20 reaches its open position and the window 50 is completely unobstructed by the door panel 22, the door structure 20 is once again substantially parallel to the wall 40 and the door panel 22 is hidden behind and adjacent to the wall 40, as shown in FIG. 2C. While the door structure 20 is being moved to the left to open the window 50, the free end of the plate spring 42 slides against the back surface of the door panel 22. When the window 50 is completely opened, the plate spring 42 is allowed to spring forward by its own biasing force, latching the door structure 20 in the open position and preventing it from starting to close the window 50 inadvertently.

Figure 2C:
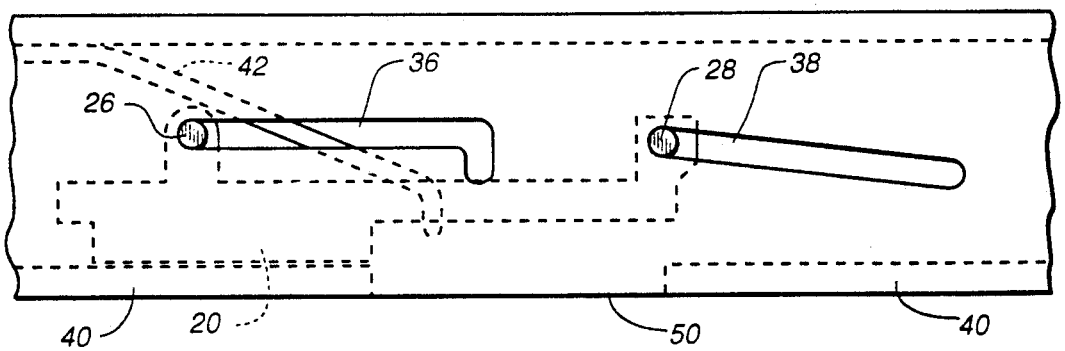

When the window 50 is to be closed from the open position shown in FIG. 2C, the free end of the cantilevered plate spring 42 is pushed backward against its forwardly biasing force in order to release the door structure 20 from the latched condition, and the door structure 20 is thereafter moved to the right.

With a sliding door assembly thus formed, the door does not take up any significant space outside the windowed wall, and the chances are much smaller that it will be damaged because it is protected by the surrounding walls.

Although the invention has been described above with reference to only one embodiment, this example is intended to be illustrative and not limitative. Many modifications and variations are conceivable within the scope of this invention. For example, the guide slots may be replaced by grooves serving as passageways for guiding the corresponding guide pins therealong. Although the door was described as sliding horizontally, it is to be noted that the structure according to the present invention may be installed in any orientation. In summary, the specification is intended to be interpreted broadly and such modifications and variations that may be apparent to persons skilled in the art are intended to be within the scope of the invention.

What is claimed is:

1. A window structure comprising:

a wall having a window;

a door structure which is slidable between an open position and a closed position, said door structure at said open position being parallel and adjacent to said wall and leaving said window open, and said door structure at said closed position covering said window completely;

a first pin and a second pin attached to said door structure;

a guide structure affixed to said wall, said guide structure having a first elongated passageway and a second elongated passageway, said first and second pins being inside and constrained to move between said open and closed positions inside and along said first and second passageways, respectively; and biasing means for exerting a biasing force on said door structure so as to keep said window closed when said door structure is at said closed position and to prevent said door structure from starting to move from said open position when said door structure is in said open position.

2. The window structure of claim 1 wherein said biasing means includes an elongated elastic member with a free end thereof in contact with said door structure and being attached to a frame to which said wall is affixed.

3. The window structure of claim 1 wherein said door structure includes a door panel for covering said window completely when said door structure is in said closed position, said door panel being substantially parallel and adjacent to said wall when said door structure is in said open position.

4. The window structure of claim 3 wherein said first pin is directly behind said door panel, and said second pin is distal from said door panel.

5. The window structure of claim 4 wherein said first passageway is L-shaped with a shorter branch substantially normal to said wall and a longer branch substantially parallel to said wall, and wherein said second passageway is substantially straight and oblique to said wall.

6. The window structure of claim 5 wherein said first pin is one of a pair of first pins protruding from said door structure in mutually opposite directions and colinearly, and wherein said second pin is one of a pair of second pins protruding from said door structure in mutually opposite directions and colinearly.

7. The window structure of claim 6 wherein said guide structure is one of a pair of similarly formed guide structures, each of said guide structures being coupled with one of said pair of first pins and one of said pair of second pins.

8. The window structure of claim 1 wherein said first pin is one of a pair of first pins protruding from said door structure in mutually opposite directions and colinearly, and wherein said second pin is one of a pair of second pins protruding from said door structure in mutually opposite directions and colinearly.

9. The window structure of claim 8 wherein said guide structure is one of a pair of similarly formed guide structures, each of said guide structures being coupled with one of said pair of first pins and one of said pair of second pins.

* * * * *